United States Patent [19]

Martinez.

[11] Patent Number: 4,777,902

[45] Date of Patent: Oct. 18, 1988

[54] INFORMATION RETRIEVAL DEVICE

[76] Inventor: Fernando E. Martinez, 1524 S. Bundry Dr., West Los Angeles, Calif. 90025

[21] Appl. No.: 933,399

[22] Filed: Nov. 21, 1986

[51] Int. Cl.[4] ..... B42D 9/00; B42D 17/00; B42F 15/00

[52] U.S. Cl. ..... 116/234; 116/235; 24/299; 248/489; 281/45; 402/80 R

[58] Field of Search ..... 116/234–237, 116/240, 222, 306, 307, 325, 326; 281/42, 45, 46, 15 A; 235/123; 273/DIG. 26; 248/489, 497, 339, 359 G, 359 I, 447; 24/67 R, 67 P, 67.9, 67 CF, 299, DIG. 8; 40/352, 360; 211/113; 312/184; 402/80 R, 4, 24, 80 L

[56] References Cited

U.S. PATENT DOCUMENTS

| | | | |
|---|---|---|---|
| 888,708 | 5/1908 | Henderson | 116/306 |
| 1,245,457 | 11/1917 | Gwynn | 116/325 |
| 1,658,499 | 2/1928 | Stevens | 116/240 |
| 1,999,583 | 4/1935 | Bouvier | 116/234 |
| 2,108,494 | 2/1938 | Lansing | 281/42 |
| 3,324,823 | 6/1967 | Peters | 116/234 |
| 3,505,973 | 4/1970 | Baker | 116/325 |
| 3,683,844 | 8/1972 | Wilkin | 116/240 |
| 3,719,161 | 3/1973 | Wegner | 116/240 |
| 3,936,201 | 2/1976 | Kenney et al. | 402/4 |
| 4,132,501 | 1/1979 | Simpson | 281/15 A |
| 4,210,093 | 7/1980 | Baker | 116/222 |
| 4,569,538 | 2/1986 | Kurschner | 281/42 |

FOREIGN PATENT DOCUMENTS

| | | | |
|---|---|---|---|
| 684866 | 11/1939 | Fed. Rep. of Germany | 402/4 |
| 389373 | 3/1933 | United Kingdom | 24/299 |
| 446849 | 5/1936 | United Kingdom | 116/240 |
| 1178479 | 1/1970 | United Kingdom | 116/235 |
| WO02867 | 10/1981 | World Int. Prop. O. | 116/239 |

*Primary Examiner*—William A. Cuchlinski, Jr.
*Assistant Examiner*—W. Morris Worth
*Attorney, Agent, or Firm*—Julius Rubinstein

[57] ABSTRACT

A combined information retrieval device comprises an elongated strip of material. A coating of an adhesive is applied to one surface of the strip. Holes are formed along the edges of the strip which are sized and spaced apart so they can be interlocked with the rings of the binder of a loose leaf notebook to identify and conveniently locate a page containing information that must be dealt with. Status indicting devices, in the form of loops which can be interlocked together, are interlocked with a hole in the strip. The adhesive holds the strip in position on a page in the binder to indicate both a page and a line on the page containing information that must be dealt with. The number of loops attached to the strip indicate the operations that have been completed and the next operation required.

4 Claims, 1 Drawing Sheet

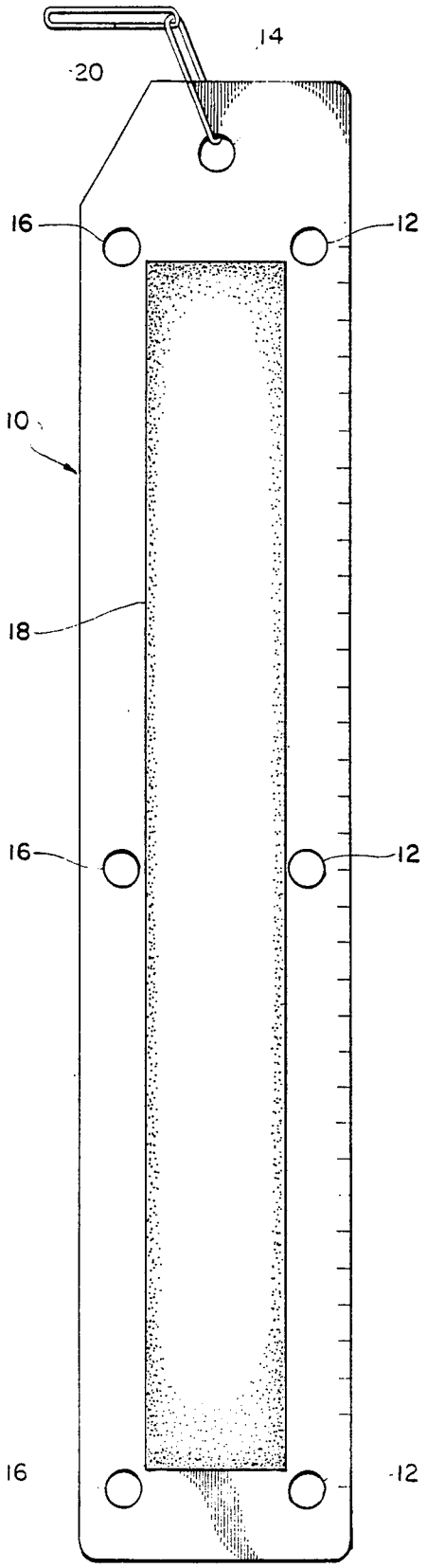
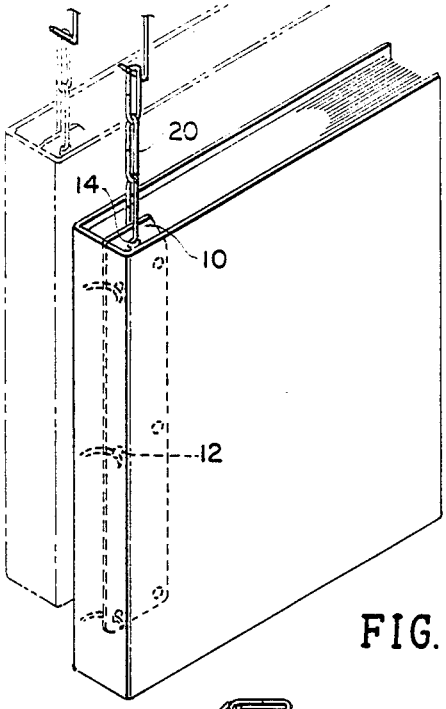
FIG. 2.
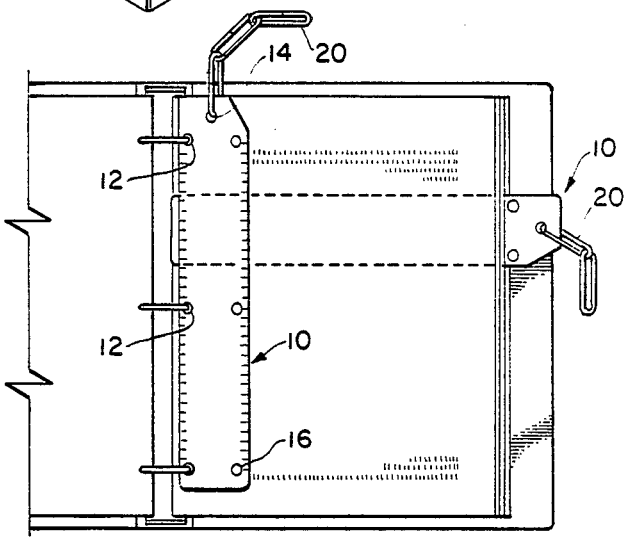
FIG. 3.
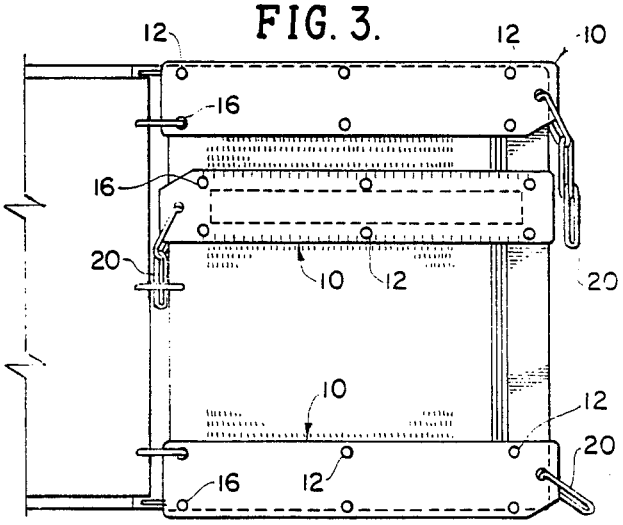

INFORMATION RETRIEVAL DEVICE

This invention relates to a combined information retrieval device and status indicator.

BACKGROUND AND STATEMENT OF PROBLEM

Many organizations store information which must be operated on in a definite sequence. For example, the information may have to be reviewed or commented on by various persons or departments in a prescribed order. Work may have to be done in a particular progression. In such organizations, it is important to be able to quickly locate the information requiring attention, and to immediately know its status, so that the next required step in the operation may be started Computers are increasingly being used for this purpose, but they are subject to the hazard of breakdown. Moreover the use of computers has obscured the fact that a conventional three ring or multi-ring notebook can serve many of the functions that computers are now serving. For example, information can be added or removed from the notebook by simply adding or removing pages containing information. Nonetheless, information stored among many sheets of paper among many notebooks is not easily accessible.

In the past, book marks and line guides, as exemplified in the patents to Lansing U.S. Pat. No. 2,108,494; Wegner U.S. Pat. No. 3,719,161; Peters U.S. Pat. No. 3,324,823; Wilkin U.S. Pat. No. 3,683,844; Bouvier U.S. Pat. No. 1,999,583; Baukus U.S. Pat. No. 1,658,499; and Steven U.S. Pat. No. 1,658,499, have been developed for the purpose of locating pages in a book or to enable a typist to accurately follow a line on a page. However, these devices were not concerned with the problem of conveniently retrieving information requiring attention and at the same time visually indicating the next operational step required.

What is needed therefore, and comprises an important object of this invention is to provide a combined information retrieval device and status indicator.

BRIEF SUMMARY

In this invention, an elongated generally rectangular strip, preferably formed from plastic, has an adhesive coating on one surface. Holes are formed along the edges of the strips. Status indicating members in the form of loops are formed from some suitable material such as plastic and are shaped so they can be interlocked together and to one of the holes in the strip. The holes in the strip are sized and spaced apart so they can be interlocked with all or some of the rings of the binder of a multi-ring notebook both to prevent the strips from falling out of the binder and becoming lost, and to locate a page or line containing the information that must be dealt with. The number and/or color of the loops interlocked with a strip indicate both the number of operations that have been completed on the information being dealt with, and the next operation in the sequence.

Other objects of this invention will become more apparent when better understood in the light of the accompanying specification and drawings wherein:

FIG. 1 is a plan view of the information retrieval device.

FIG. 2 is a perspective view showing the information retrieval device in a three ring notebook suspended from a hook and displaying by the length of the supporting chain, the number of operations that have been completed and the next operation required.

FIG. 3 is a partial plan view of an open three ring notebook showing one information retrieval device used to locate a page containing information that must be dealt with, where the device has status indicating members in the form of interlocked loops attached to it to indicate the status of the information under consideration, and showing a second information retrieval device indicating both the page and line where the information is located, and indicating the operations that have been completed and the next operation waiting action.

FIG. 4 is a plan view of a three ring notebook showing a page with three information retrieval devices used in three different ways.

Referring now to FIG. 1 of the drawing, a generally rectangular support or strip 10 formed from a preferably transparent or translucent plastic is provided with holes 12 and 16 disposed along the opposed elongated straight edges of the strip. As seen in FIG. 2, the spacing between the holes 12 is the same as the spacing between the binder rings so the information retrieval device can be interlocked with the binder rings. A portion of one surface of the strip 10 is coated with an adhesive 18 of the kind which adheres to paper.

A plurality of status indicating members which in this embodiment are in the form of loops 20, each of which may have a different color (according to a predetermined code) are interlocked with one of the holes and with each other, see FIGS. 3 and 4.

At least on dimension of the support or strip 10 is greater than the width of the page, so when the strip is mounted inside the book an edge or end of the support extends above the top or sides of the pages where it can be seen, see FIGS. 3. and 4. A portion of one surface of the strip 10 is coated with an adhesive 18 of the kind which adheres to paper.

In use when a strip 10 is interlocked with one of the rings of the binder, it indicates a page where information that requires attention is located. The color, and/or number of loops 20 interlocked with one of the holes 14 in the strip indicate the number of operations that have been performed and the next operation that is required. As the number of steps or stages in an operation are completed, the number of loops 20 interlocked with each other is added (or subtracted) until the number of loops attached to a strip indicate the operation has been completed.

As shown in FIG. 4, the strips can be used to indicate a particular line and page where the information that requires attention is located. To do this, the strip 10 is laid on the page containing the information requiring attention, with the adhesive side down and with an elongated straight edge positioned under a line containing the information that requires attention. The narrow end of the strip extending out from the side of the pages in the binder makes it possible to quickly locate the page and the line on the page containing the information that requires attention. The number of loops attached to the strip which can be seen extending out from the side of the binder indicates the status of the information and the next step required. It is noted, as seen in FIG. 3, that the adhesive can hold the strip in position under a line on a page when the notebook is closed, even if a binder ring is not interlocked with a hole in the strip. In this way, the device can be used with ordinary books to designate pages or lines of interest, and by the use of the loops attached to a strip 10, to indicate what is to be done with that information.

If binders are filed so just the top or bottom edge of the binder is visible, the elongated straight edges of the strip 10 extending beyond the top or bottom edges of the paper in the binder, see FIG. 4, indicate that the binder contains information that requires attention.

The loops 20 interlocked to each other end to end and with a first loop or status indicating member interlocked with hole 14 at the narrow end of the strip 10, form a chain which may be used to suspend the binder from a support such as a hook, when the strip 10 is interlocked with the binder rings, as illustrated in FIG. 2. If the organization has many binders suspended in a line from various hooks, the number or color of the loops supporting the binders, which are clearly visible, indicate which binders contain information requiring attention and the next operational step required. It is apparent that these information retrieval devices provide a quick inexpensive way to locate information requiring attention and designate the action that is required.

Although in the embodiment shown in the drawings, loops, which may be like paper clips or key rings, are described as being interlocked with a hole in the strip 10, other status indicating devices are contemplated. For example, if the strip 10 were formed from a magnetic material, numbers of bar magnets may be stuck together end to end to indicate by their number, the status of the information requiring attention.

Having described the invention what I claim as new is:

1. A combined information retrieval device for use in an organization that uses a book that contains pages containing various kinds of information that requires a number of operations to be performed sequentially by different entities in the organization, said information retrieval device comprising a support for suspending the book from a hook, said support having means for removeably attaching said support to at least one ring of said book between the pages of the book, said support having first means for adhering to a portion of a particular page in the book containing the information that is required for completing a particular operation in the sequential series of operations to be worked on, and second means that indicates subsequent operations and entities responsible for completing said subsequent operations, said second means comprising a plurality of entity indicating members or chain links removeably connected together and forming a chain, so that each link in said chain can be removed or added to indicate that an operation indicated by that link has been completed or needs to be completed, respectively, by a particular entity, said support having at least one chain receiving hole, at least one chain link attached to said hole, whereby if said chain is suspended from said hook, the number of links in the chain indicate the remaining number of operations required to be completed and the particular entities responsible.

2. The combined information retrieval device described in claim 1 wherein said first means on said support includes a coating of adhesive on one surface so by pressing the surface of the support containing the coating of adhesive under a precise line on a page that contains the information being worked on the support will adhere to that portion of the page when the book is closed, the length of said support such that a portion of the support will extend out beyond the borders of the book when the book is closed so that the page and line in the book that requires work by a subsequent entity in the sequence of operations will be quickly located when the book is opened.

3. the combined information retrieval device described in claim 1 wherein said book contains binder rings, said support contains binder ring receiving holes which are located in such a way that the support can be interlocked with the binder rings, said chain attached to said support and strong enough so the book can be suspended from a hook, so that by inspection of the number of links in the chain, the entity responsible for the next operational step in the work can be quickly identified.

4. The combined information retrieval device and status indicator described in claim 3 wherein said chain receiving hole is formed in the support, so that said at least one link in the chain is attachable to said support, and the remaining links in the chain being attachable to each other and said at least one link to indicate by the number of links remaining in the chain both the number of operations in the organization remaining for completion, and the particular entity required to perform the next sequential operation

* * * * *